US011731009B1

(12) United States Patent
Judge

(10) Patent No.: US 11,731,009 B1
(45) Date of Patent: Aug. 22, 2023

(54) PUTTER ASSEMBLY HAVING AN IMAGE SENSOR AND DISPLAY ASSOCIATED THEREWITH

(71) Applicant: Ronald Dale Judge, Mecosta, MI (US)

(72) Inventor: Ronald Dale Judge, Mecosta, MI (US)

( * ) Notice: Subject to any disclaimer, the term of this patent is extended or adjusted under 35 U.S.C. 154(b) by 0 days.

(21) Appl. No.: 17/940,415

(22) Filed: Sep. 8, 2022

(51) Int. Cl.
*A63B 53/00* (2015.01)
*A63B 53/04* (2015.01)

(52) U.S. Cl.
CPC ..... *A63B 53/007* (2013.01); *A63B 53/0441* (2020.08); *A63B 2225/00* (2013.01)

(58) Field of Classification Search
CPC .... G16H 40/63; A63B 69/3614; A63B 60/42; A63B 53/007
See application file for complete search history.

(56) References Cited

U.S. PATENT DOCUMENTS 4,601,472 A * 7/1986 O'Flanagan ..... A63B 69/3685 473/240
5,213,331 A * 5/1993 Avanzini ..... A63B 69/3614 473/220
5,842,932 A * 12/1998 Goddard ..... A63B 69/3685 273/DIG. 30
6,089,988 A * 7/2000 Winslow ..... A63B 69/3685 473/409
6,196,932 B1 * 3/2001 Marsh ..... A63B 60/46 473/409
6,872,149 B1 * 3/2005 Devon ..... A63B 69/3685 473/238
7,318,778 B2 * 1/2008 Owens ..... A63B 69/3685 473/223
7,556,569 B1 * 7/2009 Caserta ..... A63B 69/3685 473/238
8,303,427 B1 * 11/2012 High ..... A63B 69/3614 473/220
2002/0173365 A1 * 11/2002 Boscha ..... A63B 69/362 473/131
2009/0163285 A1 * 6/2009 Kwon ..... A63B 69/3685 473/409
2010/0035703 A1 * 2/2010 Ishikawa ..... A63B 53/0487 473/340
2011/0081981 A1 * 4/2011 Okamoto ..... G01P 5/16 473/233
2012/0184398 A1 * 7/2012 Ikka ..... A63B 69/3685 473/407
2013/0344973 A1 * 12/2013 Margoles ..... A63B 60/42 473/409
2014/0100047 A1 * 4/2014 Noh ..... A63B 69/3676 473/220
2014/0200092 A1 * 7/2014 Parke ..... G01C 21/16 473/409

(Continued)

*Primary Examiner* — Eugene L Kim
*Assistant Examiner* — Christopher Glenn
(74) *Attorney, Agent, or Firm* — King & Partners, PLC

(57) ABSTRACT

A putter assembly, configured to facilitate improved alignment by enabling the face angle of the putter to be properly aligned with the hole, including: (a) an elongated shaft; (b) a putter head; (c) a grip; (d) an image sensor, wherein the image sensor is associated with at least one of the putter head and the elongated shaft; (e) a display, wherein the display is in communication with the image sensor; and (f) an energy source, wherein the energy source is in electrical communication with the image sensor and the display.

1 Claim, 15 Drawing Sheets

(56) References Cited

U.S. PATENT DOCUMENTS

| | | | | |
|---|---|---|---|---|
| 2018/0193714 | A1* | 7/2018 | Bittner | A63B 69/3685 |
| 2019/0105544 | A1* | 4/2019 | Carter | A63B 53/0466 |
| 2019/0336834 | A1* | 11/2019 | Greaney | A63B 53/0412 |
| 2020/0061438 | A1* | 2/2020 | Kim | A63B 69/3614 |
| 2020/0078655 | A1* | 3/2020 | Jung | A63B 60/46 |
| 2020/0276488 | A1* | 9/2020 | Cottam | G16H 40/63 |

* cited by examiner

PUTTER ASSEMBLY HAVING AN IMAGE SENSOR AND DISPLAY ASSOCIATED THEREWITH

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The present invention relates in general to golf equipment, and, more particularly, to putters having image sensors (e.g., one or more cameras, etcetera) and displays associated therewith that facilitate improved alignment by enabling the face angle of the putter to be properly aligned with the target (e.g., hole, pin, etcetera). The putters of the present invention remove the alignment variable so that the golfer can focus his/her putting practice on speed and stroke mechanics. Notably, in certain embodiments of the present invention, the sensors and displays can be deactivated so that the same club, having the same club weight, can be used for both practice and play.

2. Background Art

Putters and alignment aids have been known in the art for years and are the subject of a plurality of patents and/or publications, including: U.S. Pat. No. 7,374,497 entitled "Golf Putter Head with Visual Alignment System," U.S. Pat. No. 7,118,488 entitled "Training Putter with Laser Line Projecting Device," U.S. Pat. No. 6,089,988 entitled "Putter Alignment Device and Method of Using Same," U.S. Pat. No. 5,707,296 entitled "Training Putter with Laser Line Alignment System," U.S. Pat. No. 5,611,739 entitled "Golf Club Putter with Laser Aiming System," U.S. Pat. No. 5,433,444 entitled "Targeting Putter," U.S. Pat. No. 5,388,831 entitled "Luminous Golf Practice Device," U.S. Pat. No. 4,953,866 entitled "Golf Putter Having a Mirror," United States Patent Application Publication Number 2007/0167248 entitled "Golf Putter with Laser," and United States Patent Application Publication Number 2006/0281577 entitled "Golf Putter with Removable Laser"—all of which are hereby incorporated herein by reference in their entirety including all references cited therein.

U.S. Pat. No. 7,374,497 appears to disclose a mallet-style golf ball putter with a hollow pipe component that has generally the same diameter as a golf ball, that is positioned about the sweet spot in the vertical and lateral dimensions on the putter striking face, and extends longitudinally towards the rear of the putter to assist the golfer to align the striking face of the putter with the golf ball when in an address position and with the intended line of putt during takeback and follow-through. Peripheral weighting further enhances the moment of inertia of the golf putter head. The pipe component so designed permits a visual alignment of the striking face with the golf ball in the lateral and vertical dimensions and for a smooth perpendicular stroke along an axis of the pipe.

U.S. Pat. No. 7,118,488 appears to disclose a training putter with a laser line projecting device that can be used for putting training to improve putting skill. The device is affixed to a putter head above its sweet spot, and emits a vertical light fan which projects a line on the around normal to the face of the putter head. The line is aligned with the sweet spot of the putter head and lies on the ground to connect the top of a golf ball with a target, such as a cup or a putting hole, so that alignment can be easily visualized. The device can be detached and reattached easily without any laser alignment. Furthermore, the device can be removably mounted to a user's own putter. The heat generated in the laser diode is quickly dissipated through the metal housing, the metal putter head, and the metal shaft to the surrounding air. Since proper operating temperature of the laser diode can be maintained, the laser diode operates properly, which means the power of the emitted light is not decreased, and the lifetime of the diode is not shortened.

U.S. Pat. No. 6,089,988 appears to disclose a putter alignment device that includes a mounting frame for engaging a putter and for aligning the device relative to the putter face. A mirror frame having a mirror supported thereby is coupled pivotally to the mounting frame for aligning the putter relative to a target. A securing arrangement is adapted to engage the mounting frame at a portion thereof, extend behind the putter, and engage another portion of the mounting frame to attach removably the putter alignment device on the putter. Sight members facilitate positioning of the eyes of the golfer relative to the target line as a part of the alignment method.

U.S. Pat. No. 5,707,296 appears to disclose a putter including a club head, a shaft, a handle, a ball striking face, a heel, a toe, and an upper surface, with the shaft being connected to the upper surface, and a pair of light sources located in the ball striking face. One light source is located adjacent to the heel and other light source is located adjacent the toe. Also, included in the putter is a power source for energizing the light sources; a switch for connecting the light sources to the power source; and, an optical device associated with each of the light sources for focusing a light beam from said light sources, when the light sources are energized, into a continuous, visible linear image of light in the form of a persistent, visual pair of alignment lines on a putting surface. The pair of alignment lines extend forwardly of and perpendicular to the striking face from a point on the putting surface adjacent the ball striking face towards a remote target, said image being formed at each side of a golf ball when the putter head is in place behind the ball prior to and during the execution of a putting stroke.

U.S. Pat. No. 5,611,739 appears to disclose a laser aiming apparatus for a golf club putter. The putter includes a head having a transversely extending generally planar front face and a generally planar rear portion formed substantially parallel to the front face and spaced apart therefrom. An electrically conductive laser housing having a laser module mounted therein is removably affixed to the head. The head is clamped between an alignment surface formed in the housing which engages the front face and a clamping element affixed to the housing which provides biased contact against the rear portion such that a laser beam emitted by the laser module is aimed in a horizontal direction substantially perpendicular to the front face. A player employs the laser beam to properly align the club face during putting practice. The apparatus includes a conductive switch element in sliding biased contact with the conductive housing for closing an electrical circuit which powers the laser module.

U.S. Pat. No. 5,433,444 appears to disclose a targeting putter having improved alignment and swing compensation means. The putter comprises a putter shaft and a putter head having a striking face, heel and toe ends, and a reflective prism mounted thereon. The reflective prism, which is a right triangle prism, is located above the striking face of the putter head, and has a concave top or front face such that a wide-angle image of the green in front of the putter head is reflected to the eye of a golfer viewing the putter head from above. Reticles on the front and top faces of the reflective prism enable the golfer to sight through the prism, across the ball and to the pin, and to align the putter head perpendicularly to the intended path. A set of rotatably adjustable swing weights are located in counterbores in the rearward face of the putter head, allowing the center of mass of the putter head to be easily shifted in both the toe-to-heel and top-to-bottom directions. Such adjustments allow for compensation of deficiencies in the golfer's stroke that tend to twist the putter head, or put too much or too little force into the swing.

U.S. Pat. No. 5,388,831 appears to disclose a device that can be fitted to or built into a golf club such as a putter to assist in learning the correct club position, in particular for indoor or home putting practice. A transmitter unit is releasably attached to the shaft of the club and comprises a laser diode for transmitting a parallel light beam towards an optical unit having a cylindrical lens above the club iron. The lens diffuses the light along a vertical plane to form a beam directed at the ground in front of the iron, whereby the player is able to see a line of light on the ball and on the ground indicating the direction in which the ball will travel depending on the position of the striking surface of the iron. In one embodiment, the optical system may be supported by an arm attached to the shaft.

U.S. Pat. No. 4,953,866 appears to disclose a golf putter that includes a putting shaft, a putting head having a front face and a rear face, an aperture extending through the putting head from the front face to the rear face thereof, a supporting plate containing a mirror mounted to the rear face of the putting head and extending at an angle from the rear face, the mirror being mounted to coincide with the aperture disposed in the putting head, whereby the golfer, from a putting position can view both the ball and the hole by looking at the surface of the mirror.

United States Patent Application Publication Number 2007/0167248 appears to disclose a golf putter that has at least one and preferably three beams, preferably laser, projecting from the front face of the putter, spread vertically. In one embodiment, a single laser is centrally mounted, to project a beam over the top of a ball positioned at the desired impact point on the face of the putter. In another embodiment, two lasers are mounted to project parallel beams on either side of a ball positioned at the desired impact point on the face of the putter. In a preferred embodiment, there are three lasers, namely one projecting a beam over the top of the ball, and two projecting parallel beams on either side of the ball. Preferably there are two switches in the grip of the putter, with the light source(s) being powered only when both switches are pressed.

United States Patent Application Publication Number 2006/0281577 appears to disclose a golf putter wherein the putter is equipped with a removable laser. The head of the putter includes a mounting plate which has a mounting plate cover. When the laser is not in use, the mounting plate cover is placed on the mounting plate. When the laser is in use, the laser which includes a mounting bracket is attached to the mounting plate. The shaft of the putter includes a battery located inside of the shaft and the electrical connection to the at least one battery. The electrical connection to the laser is located in the center of the mounting plate and is covered by a cap when not in use. An on/off switch and a height adjustment switch are located on the shaft. The on/off switch controls the electricity to the laser and the height adjustment switch allows a user to pivot the laser as necessary.

While the above-identified patents and publications do appear to disclose various putters and alignment aids, their configurations remain non-desirous and/or problematic inasmuch as, among other things, none of the above-identified references appear to utilize image sensors and displays that facilitate improved alignment by enabling the face angle of the putter to be properly aligned with the target.

These and other objects of the present invention will become apparent in light of the present specification, claims, and drawings.

SUMMARY OF THE INVENTION

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

The present invention is directed to a putter assembly, configured to facilitate improved alignment by enabling the face angle of the putter to be properly aligned with the hole, comprising, consisting essentially of and/or consisting of: (a) an elongated shaft; (b) a putter head (blade, half-mallet, mallet); (c) a grip; (d) an image sensor, wherein the image sensor is associated with at least one of the putter head and the elongated shaft; (e) a display, wherein the display is in communication with the image sensor; and (f) an energy source, wherein the energy source is in electrical communication with the image sensor and the display.

In a preferred embodiment of the present invention, the image sensor is associated with the putter head and/or the elongated shaft.

In another preferred embodiment of the present invention, the putter assembly further comprises an accelerometer for determining slope and/or left/right break.

The present invention is further directed to a putter assembly, configured to facilitate improved alignment by enabling the face angle of the putter to be properly aligned with the hole, comprising, consisting essentially of and/or consisting of: (a) an elongated shaft, wherein the elongated shaft comprises a length, a proximal end, and a distal end; (b) a putter head, wherein the putter head includes a toe, a heel, a face, a sole, and a top surface, and wherein the putter head is associated with the distal end of the elongated shaft; (c) a grip, wherein the grip is associated with the proximal end; (d) an image sensor, wherein the image sensor is associated with at least one of the putter head and the elongated shaft; (e) a display, wherein the display is in communication with the image sensor; and (f) an energy source, wherein the energy source is in electrical communication with the image sensor and the display.

In a preferred embodiment of the present invention, the putter head comprises a blade, a half-mallet, and/or a mallet.

In another preferred embodiment of the present invention, the image sensor is secured to the top surface of the putter head, the elongated shaft, and/or is secured to and/or forms part of the face of the putter head.

In yet another preferred embodiment of the present invention, the image sensor comprises a charge-coupled device (CCD) sensor and/or a complementary metal-oxide semiconductor (CMOS) image sensor.

In a preferred implementation of the present invention, the display is associated with, secured to, and/or forms part of the putter head.

In another preferred implementation of the present invention, the display provides distance to the target.

In yet another preferred implementation of the present invention, the display provides STIMP (i.e., green speed) conditions proximate the putter head.

In one preferred implementation of the present invention, the display provides a linear graphical overlay that emanates perpendicular to the face of the putter head.

In a preferred embodiment of the present invention, the display provides a linear graphical overlay that emanates perpendicular to the face of the putter head and is adjusted for left/right break along the path to the intended target.

In another preferred embodiment of the present invention, the display provides a linear graphical overlay that emanates perpendicular to the face of the putter head and is adjusted for slope along the path to the intended target.

In yet another preferred embodiment of the present invention, the display provides a linear graphical overlay that emanates perpendicular to the face of the putter head and is adjusted for slope and left/right break along the path to the intended target.

In a preferred aspect of the present invention, the energy source comprises and primary and/or secondary electrochemical cell.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted.

It will be further understood that the invention is not necessarily limited to the particular embodiments illustrated herein.

Figure 1:
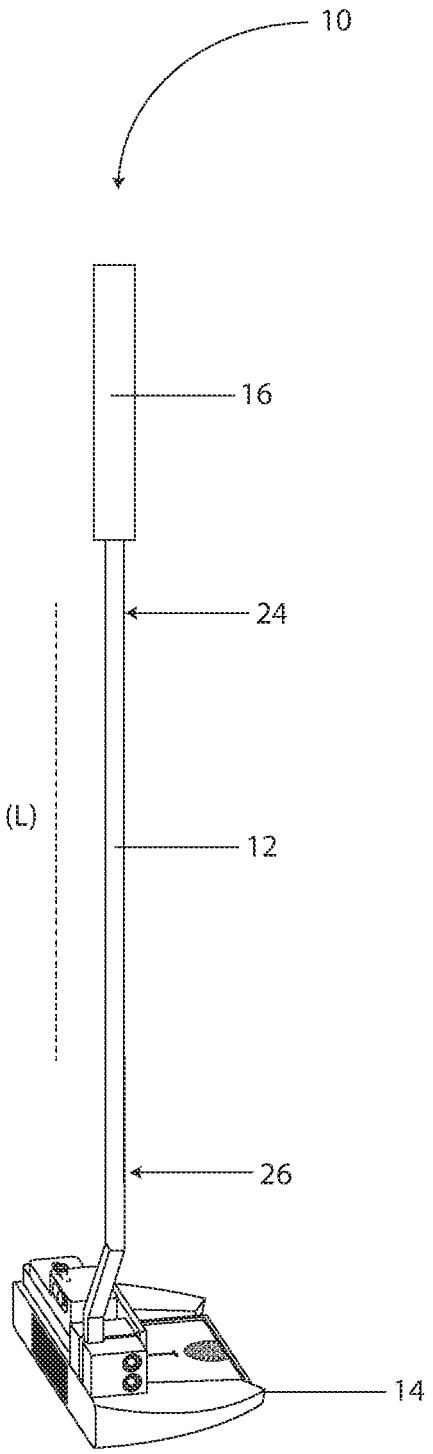
Figure 2:
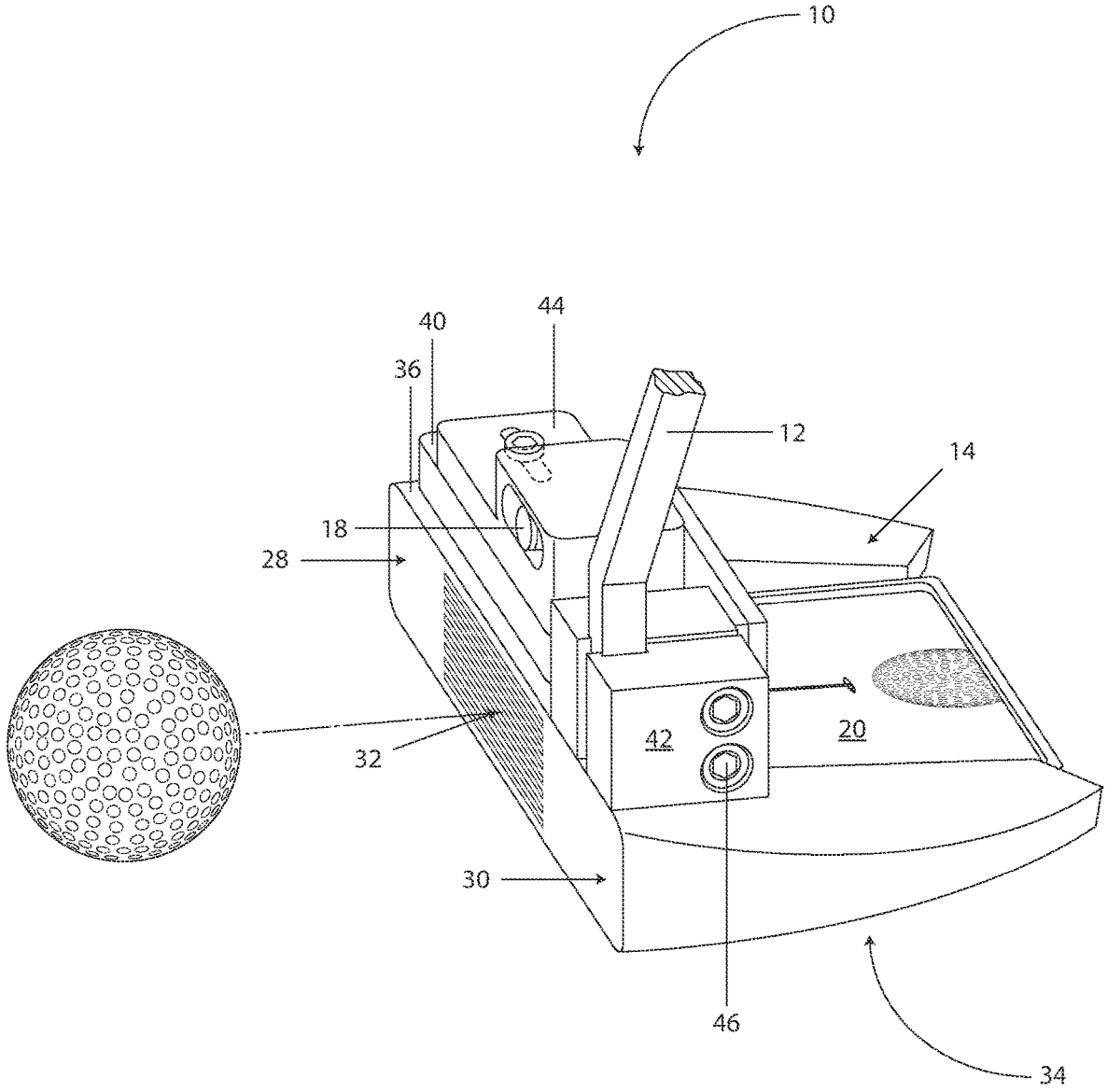
Figure 3:
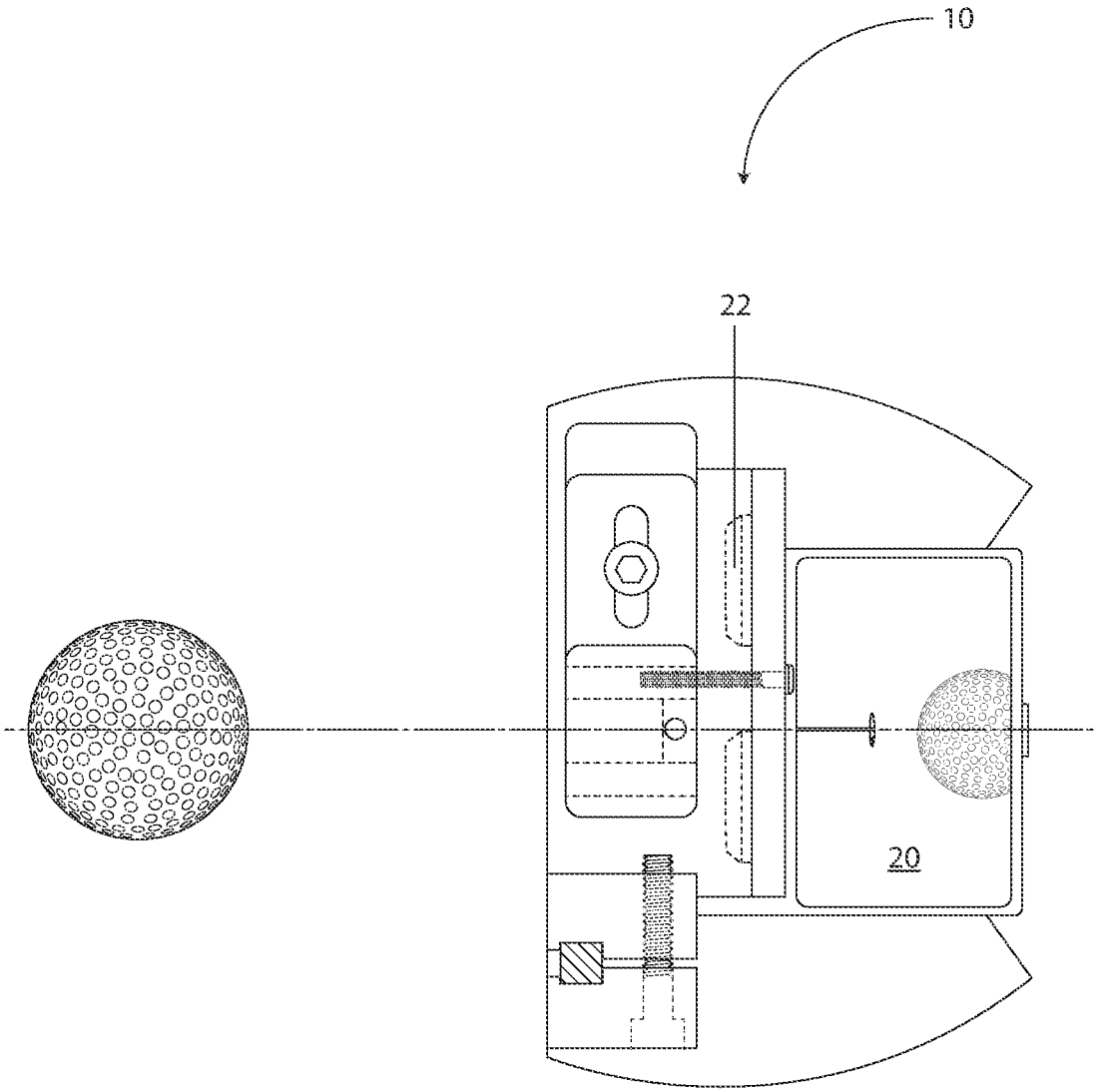
Figure 4:
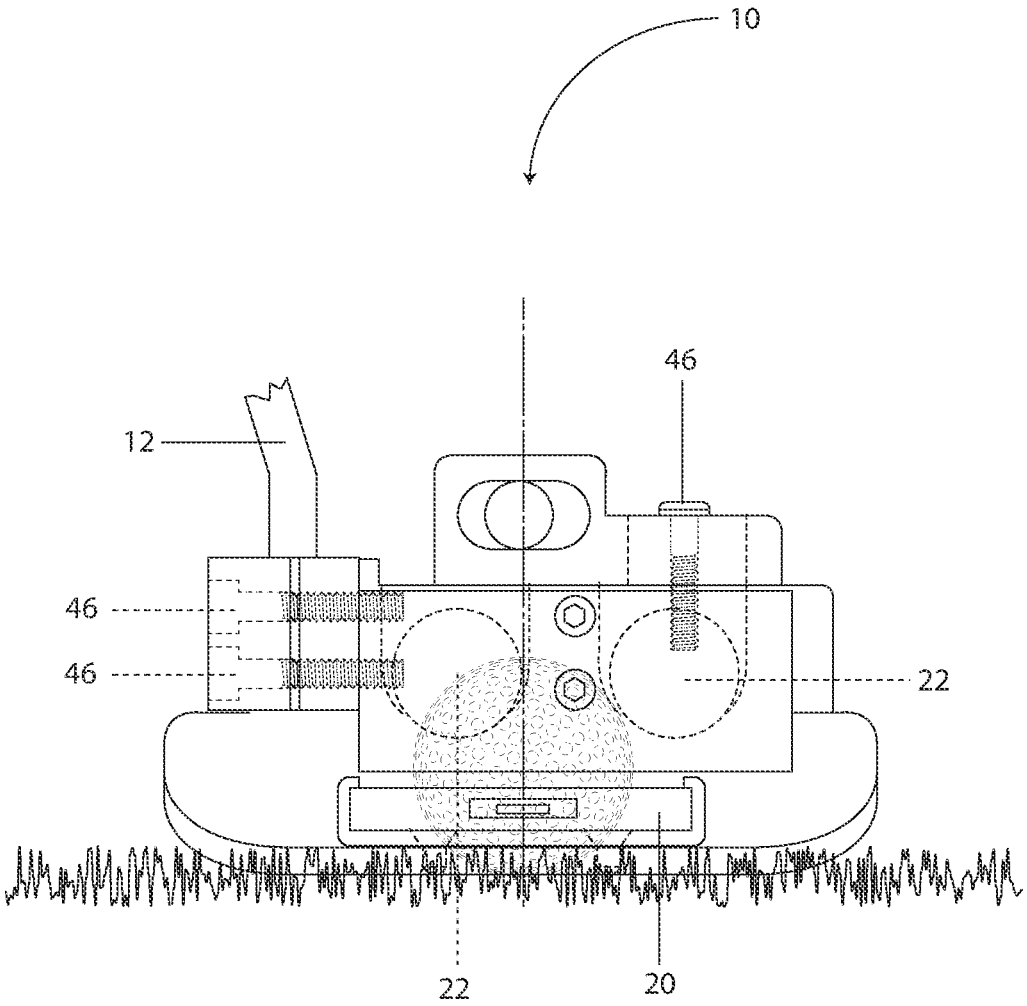
Figure 5:
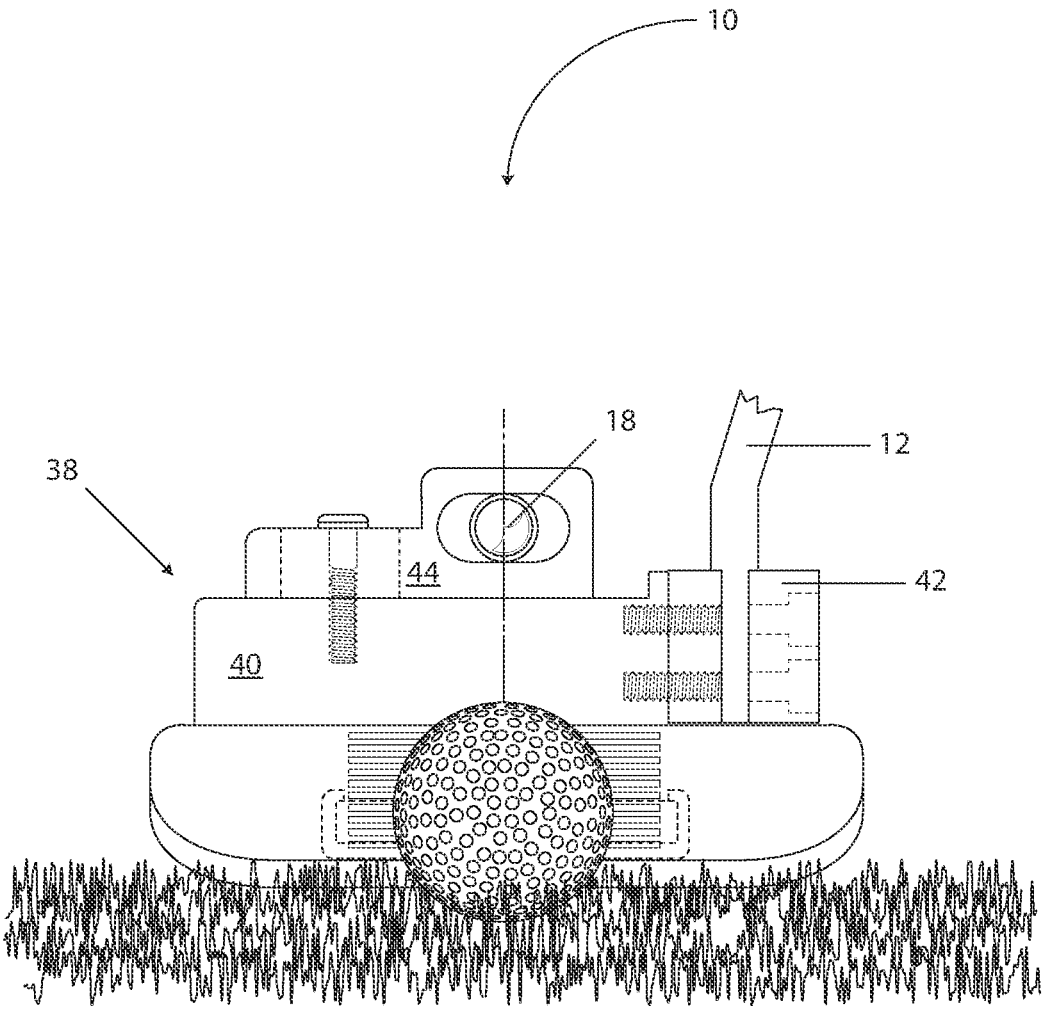
Figure 6:
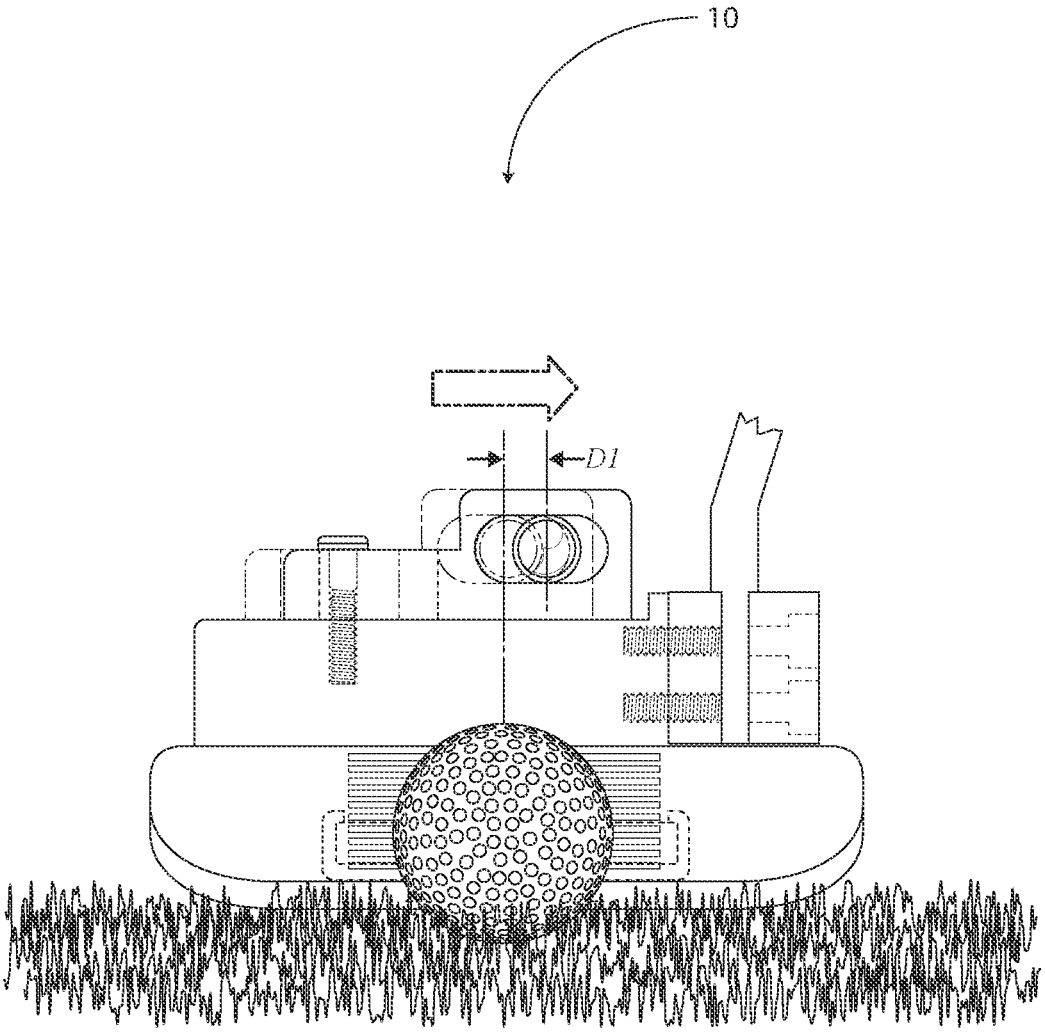
Figure 7:
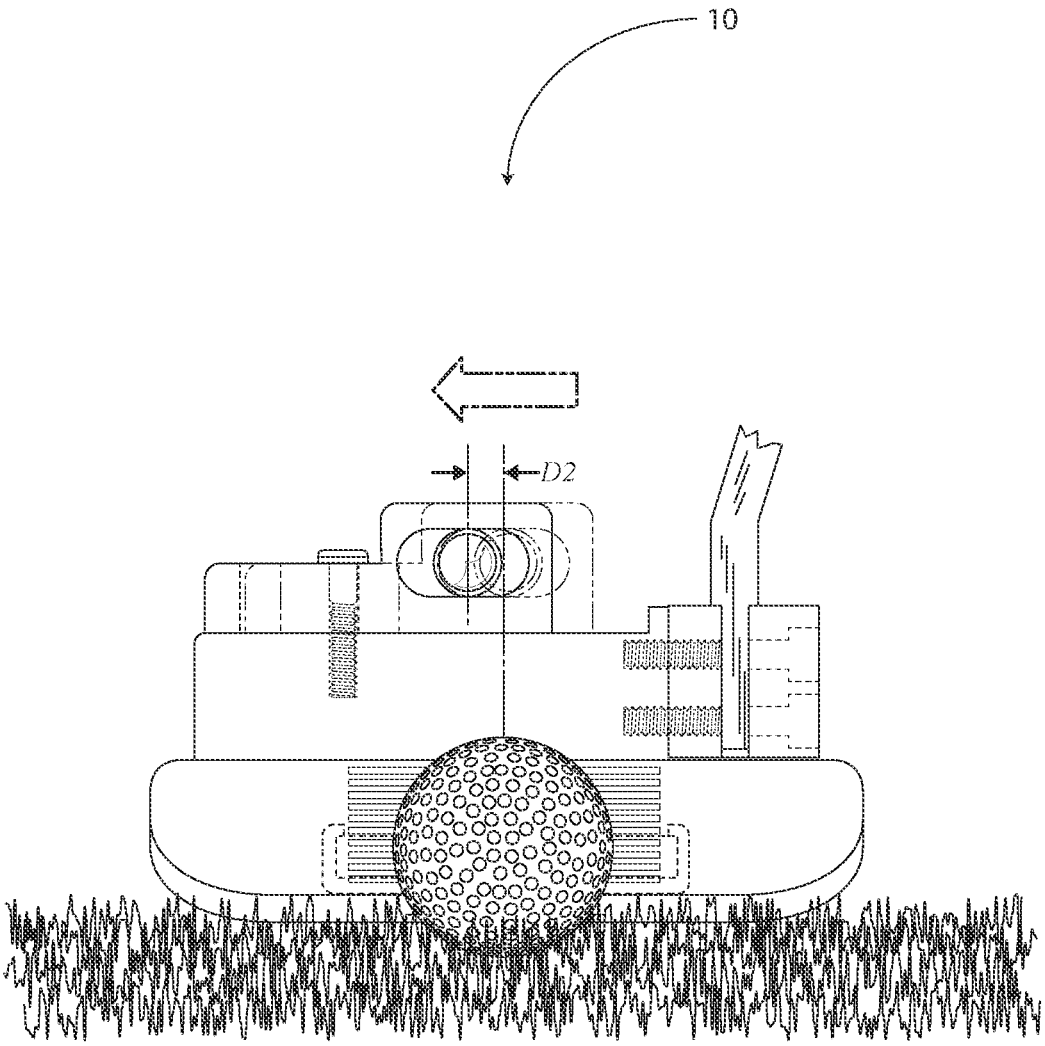
Figure 8:
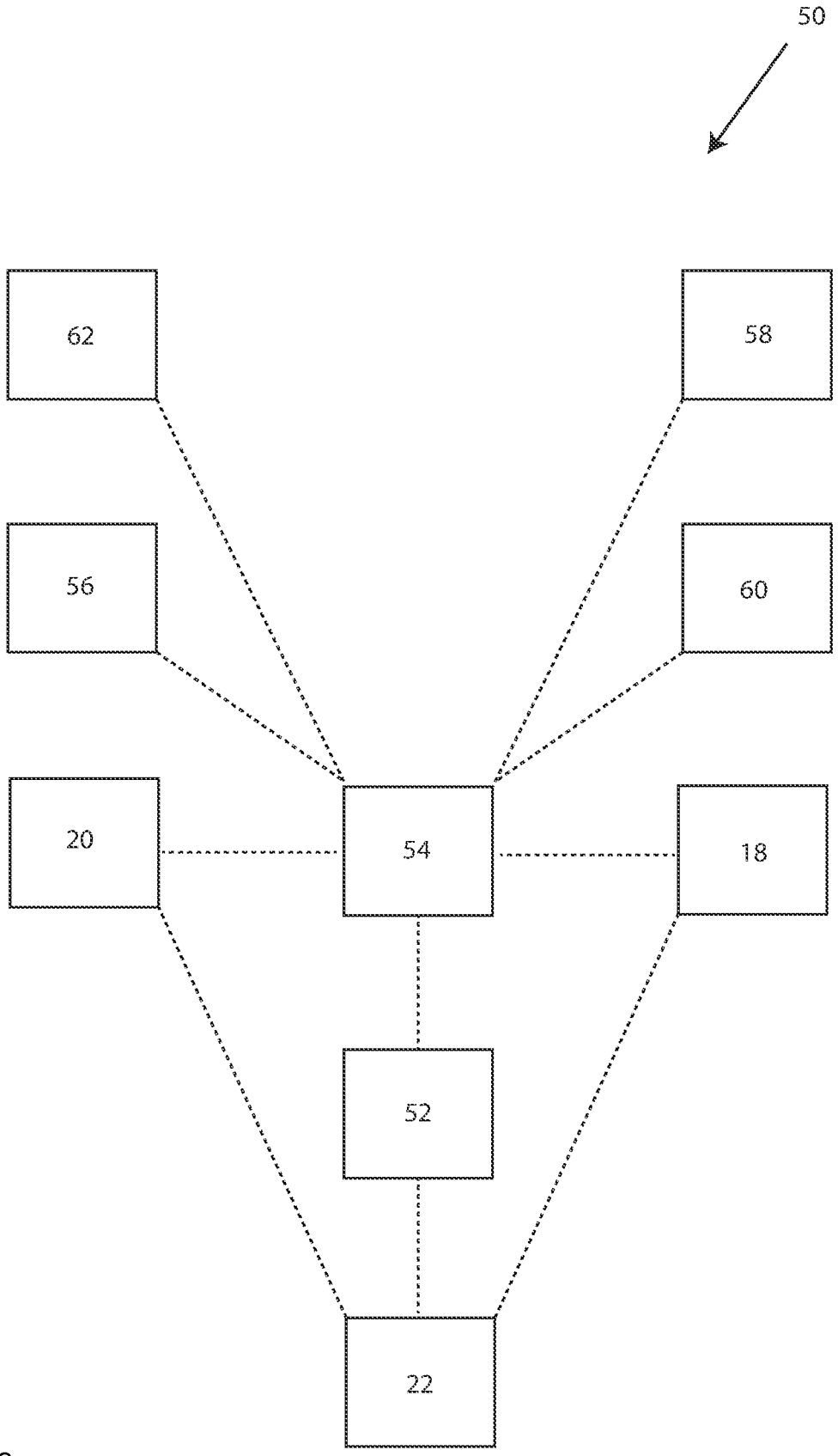
Figure 9:
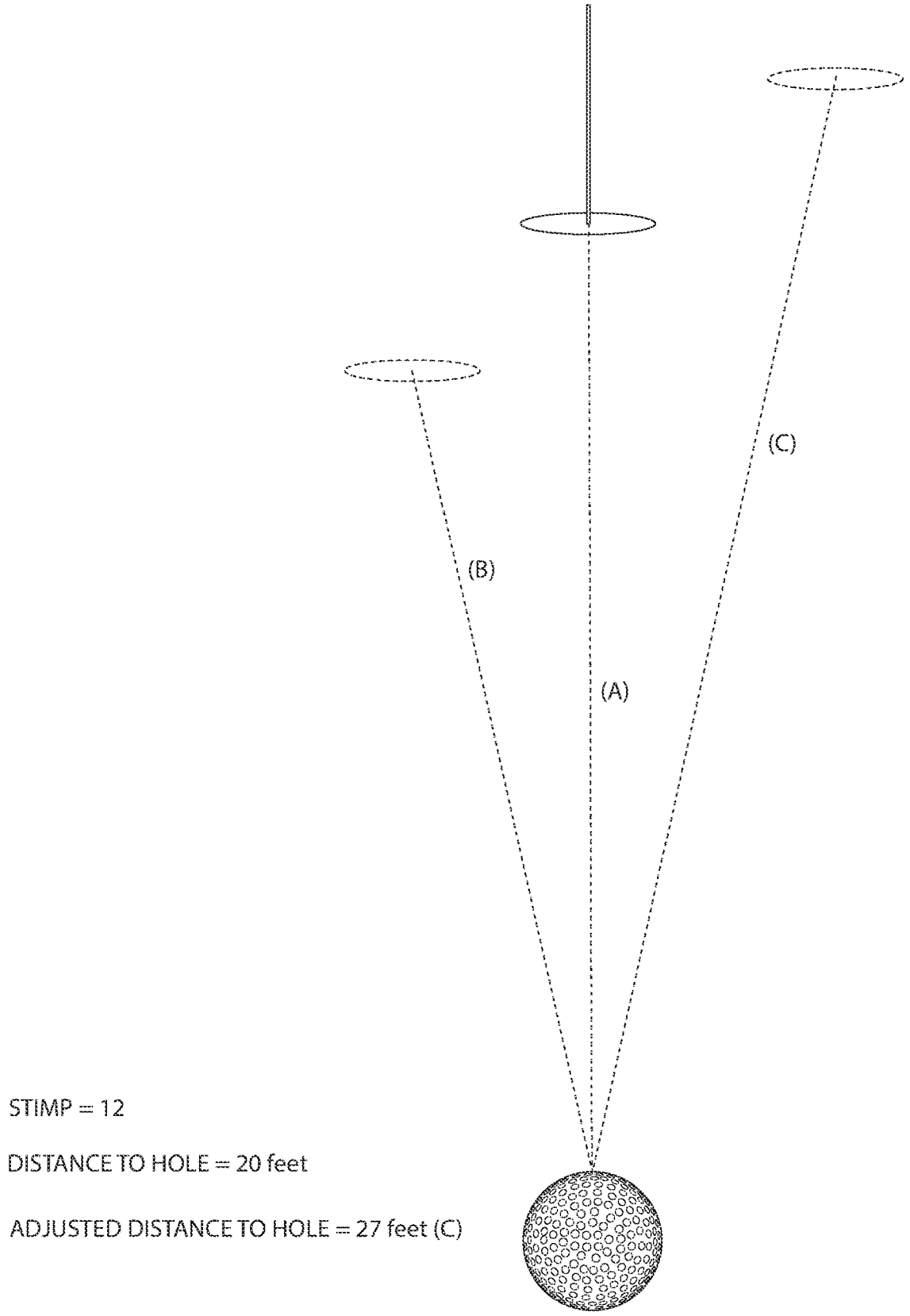
Figure 10:
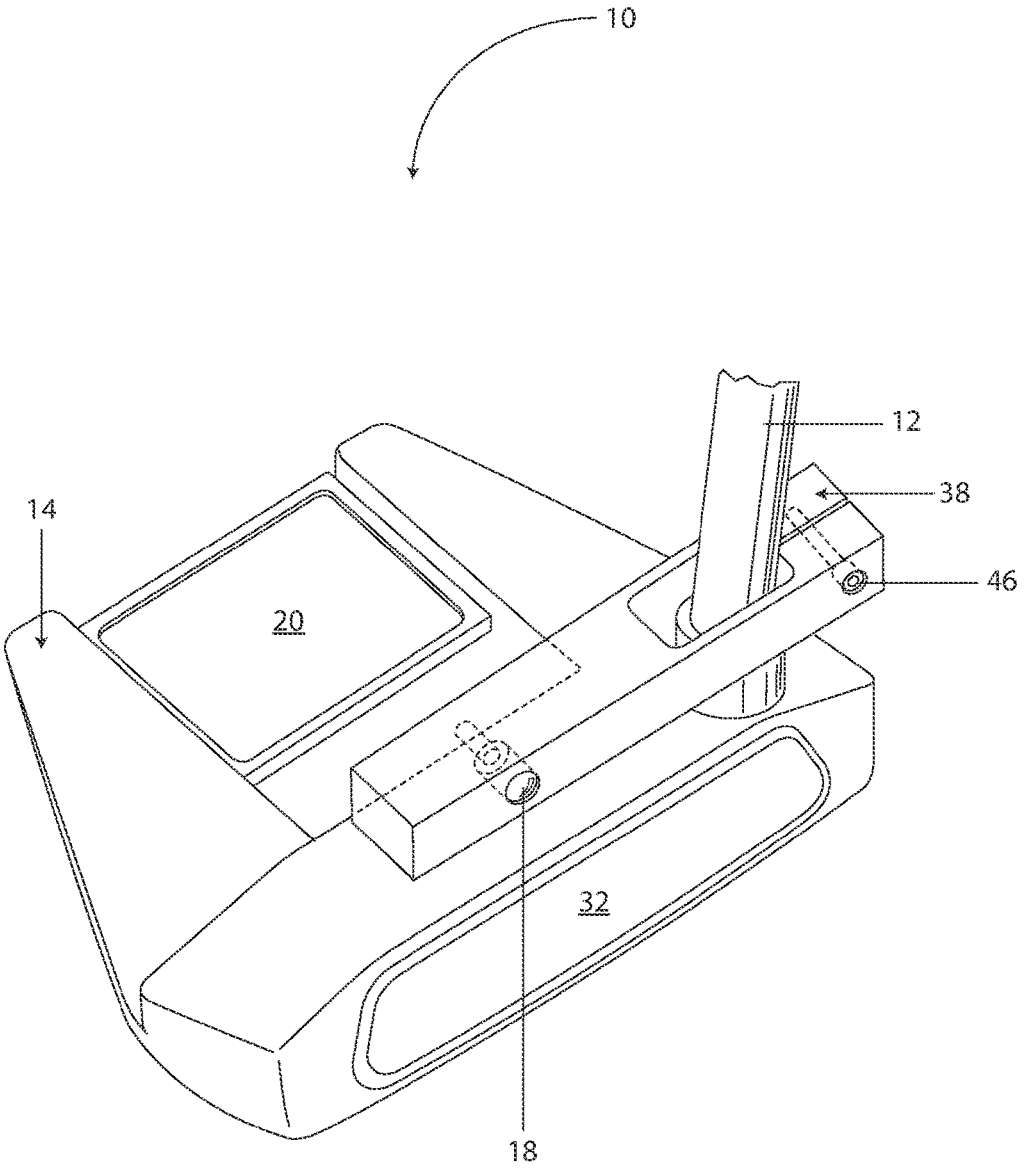
Figure 11:
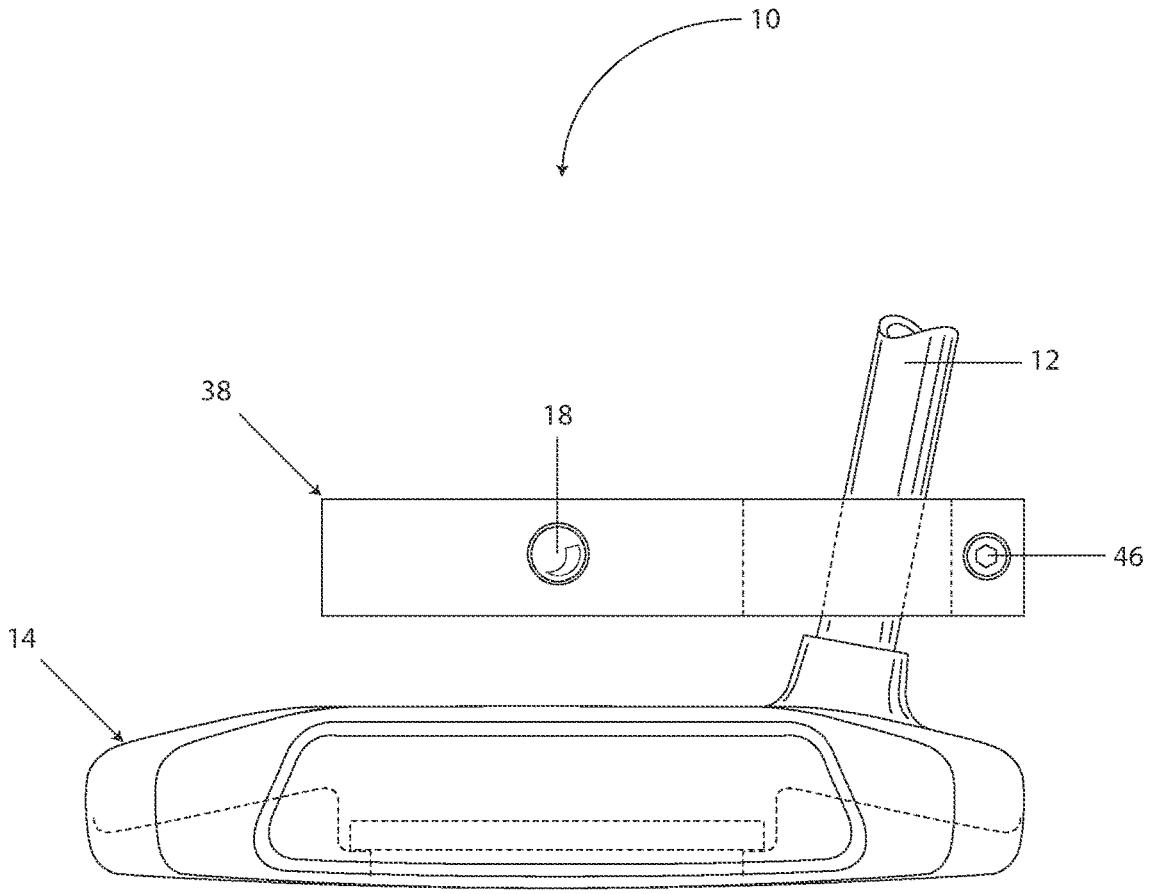
Figure 12:
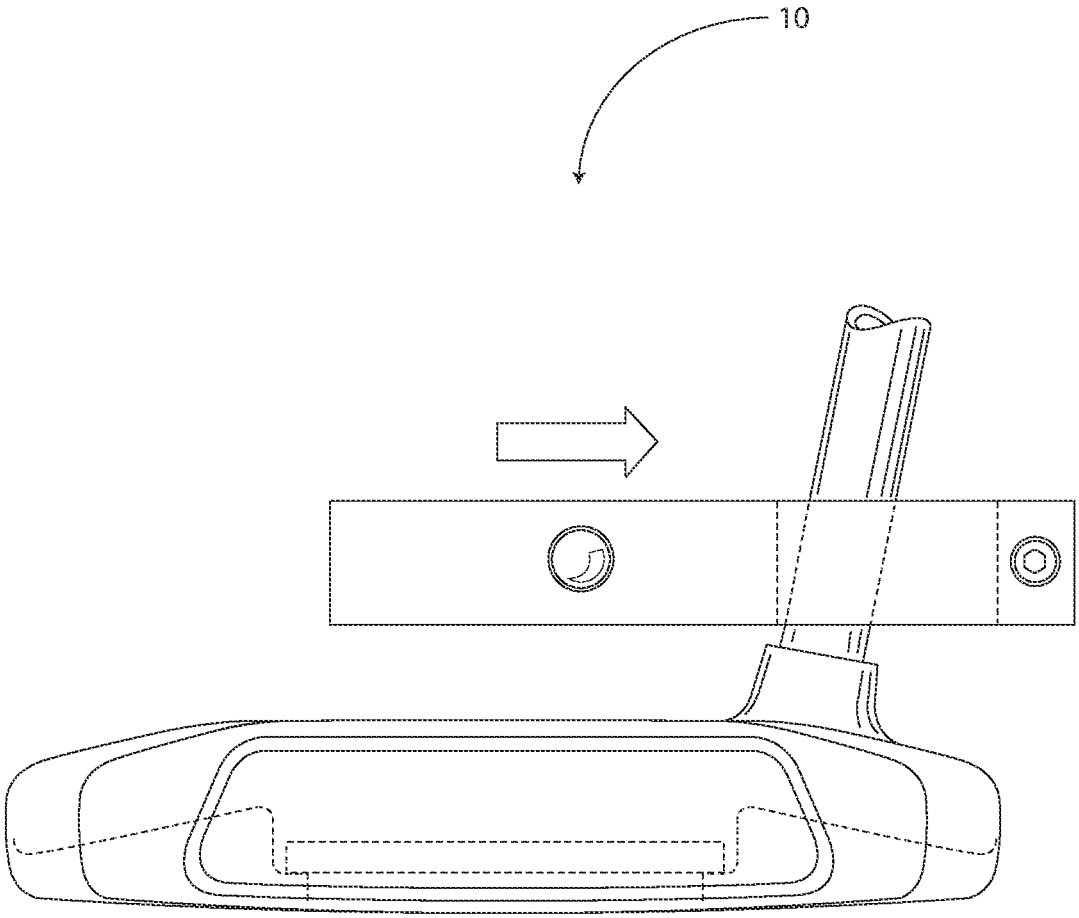
Figure 13:
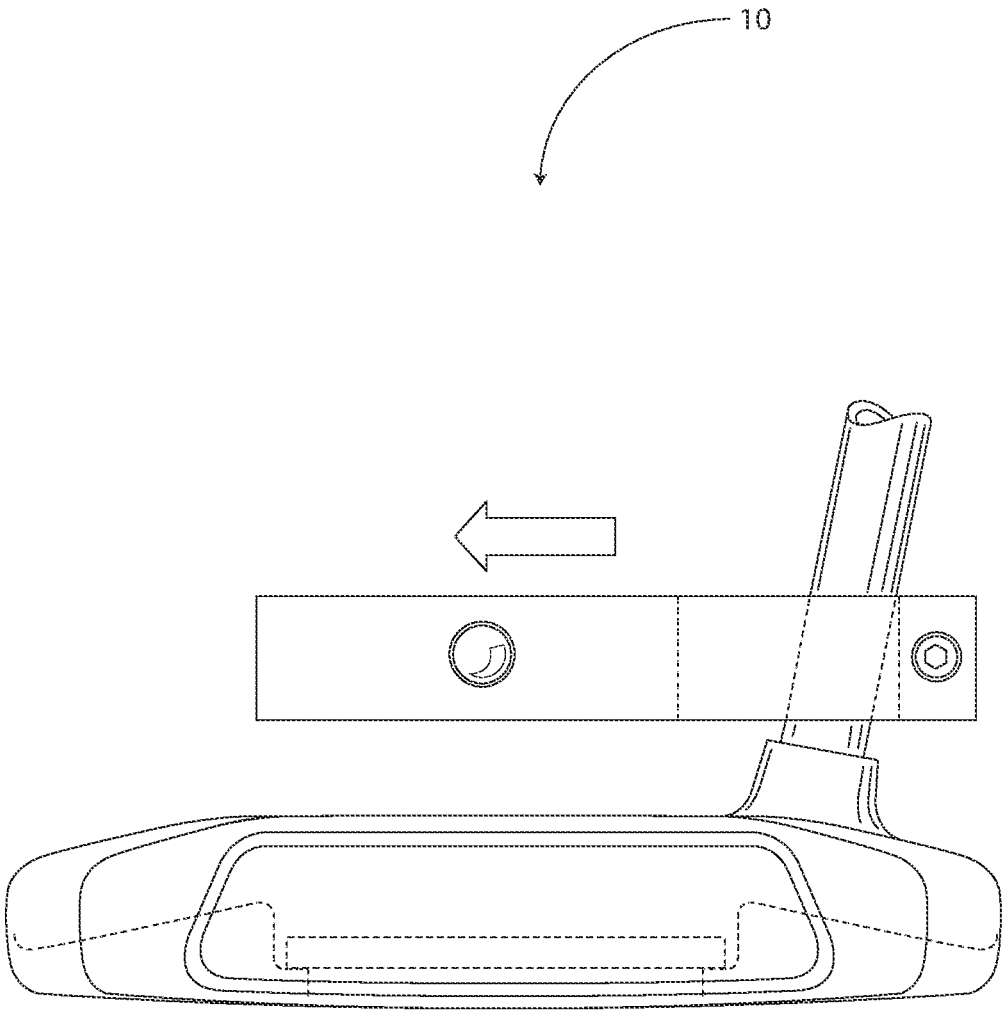
Figure 14:
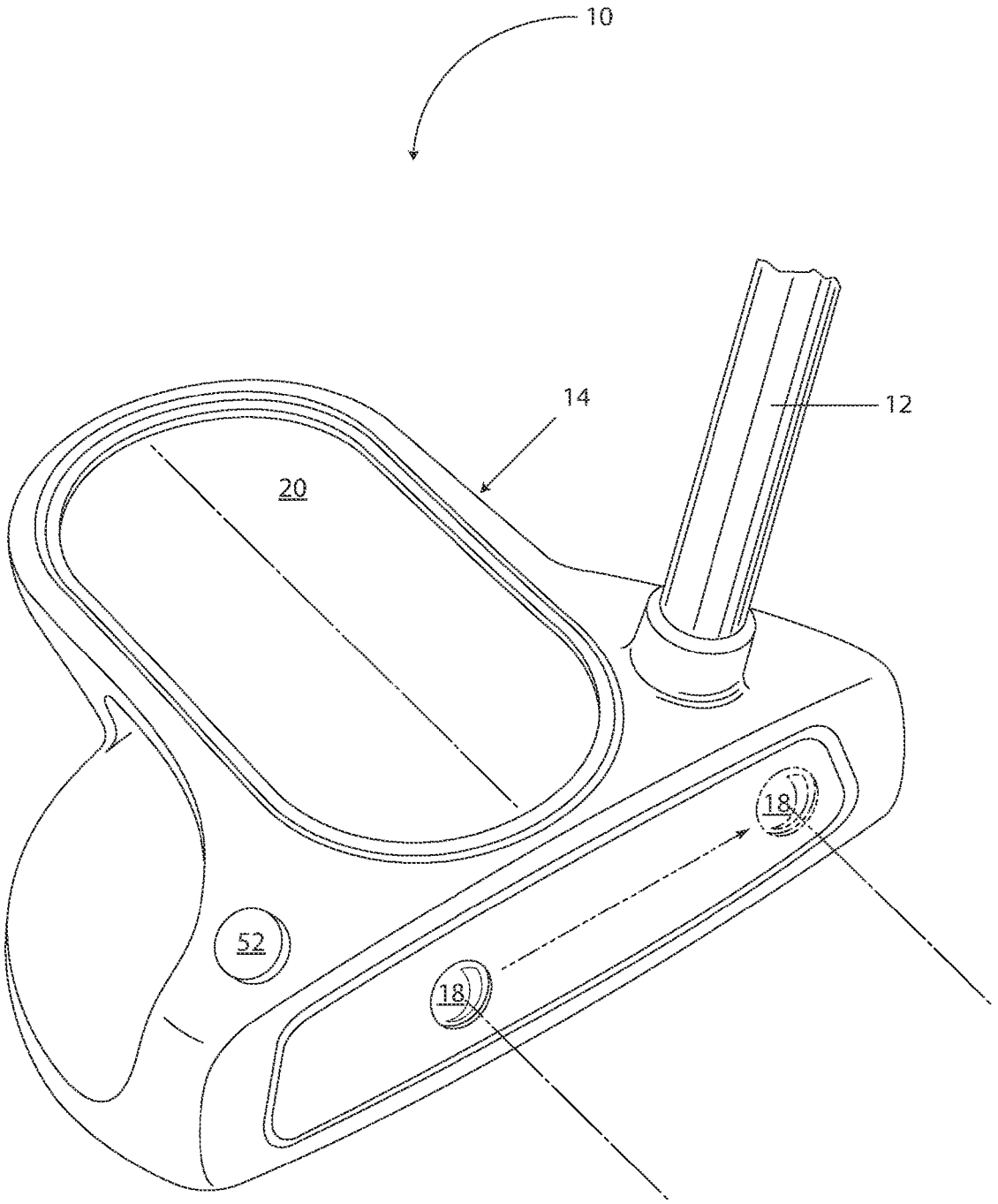
Figure 15:
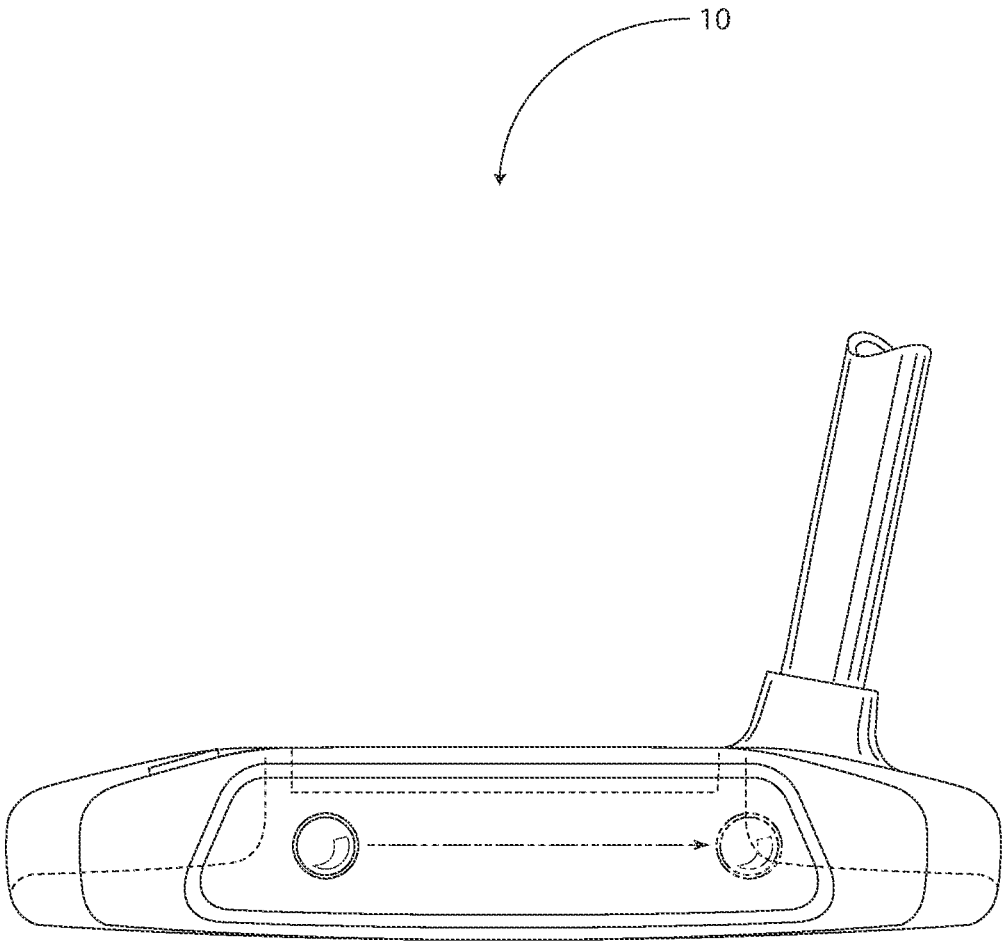

The invention will now be described with reference to the drawings wherein:

FIG. 1 of the drawings is a perspective view of a putter assembly of the present invention;

FIG. 2 of the drawings is a fragmented (i.e., partial shaft without grip) perspective view of the putter assembly of FIG. 1 showing the golf ball in play and on the display;

FIG. 3 of the drawings is a top view of the putter assembly of FIG. 2;

FIG. 4 of the drawings is a rear view of the putter assembly of FIG. 2;

FIG. 5 of the drawings is a front view of the putter assembly of FIG. 2;

FIG. 6 of the drawings is a front view of the putter assembly of FIG. 2 showing an image sensor in a first adjustment position;

FIG. 7 of the drawings is a front view of the putter assembly of FIG. 2 showing an image sensor in a second adjustment position;

FIG. 8 of the drawings is schematic representation of an electronics assembly for use in accordance with the present invention;

FIG. 9 of the drawings is a representation of a display read out in accordance with the present invention;

FIG. 10 of the drawings is a fragmented (i.e., partial shaft without grip) perspective view of a first alternative embodiment of a putter assembly of the present invention;

FIG. 11 of the drawings is a front view of the putter assembly of FIG. 10;

FIG. 12 of the drawings is a front view of the putter assembly of FIG. 10 showing an image sensor in a first adjustment position;

FIG. 13 of the drawings is a front view of the putter assembly of FIG. 10 showing an image sensor in a second adjustment position;

FIG. 14 of the drawings is a fragmented (i.e., partial shaft without grip) perspective view of a second alternative embodiment of a putter assembly of the present invention; and FIG. 15 of the drawings is a front view of the putter assembly of FIG. 14.

DETAILED DESCRIPTION OF THE INVENTION

While this invention is susceptible of embodiment in many different forms and applications, there are shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

In accordance with the present invention, the putter assemblies disclosed herein include one or more image sensors and displays that facilitate improved alignment for golf practice and play.

Referring now to the drawings, and to FIGS. 1-7 in particular, a first embodiment of putter assembly 10, is shown as generally comprising elongated shaft 12, putter head 14, grip 16, image sensor 18, display 20, and energy source 22.

Elongated shaft 12 includes a length (L), proximal end 24, and distal end 26. Elongated shaft 12 is preferably fabricated from metal, wood, and/or a graphite. These shafts are available from, for example, True Temper Sports (e.g., Dynamic Gold, Rifle) Nippon, and Aerotech—among others. It will be understood that elongated shaft 12 may house, comprise, and/or form part of any one of the components of putter assembly 10.

Putter head 14 preferably includes toe 28, heel 30, face 32, sole 34, one or more upper/top surfaces 36. Putter head 14 is preferably secured to distal end 26 of elongated shaft 12. Putter head 14 may comprise any one of a number of types or forms, including, but not limited to, a blade, a half-mallet, and/or a mallet.

In accordance with the present invention, putter head 14 is preferably fabricated from a material selected from the group consisting of a metal, a metal alloy, a natural resin, a synthetic resin, a plastic, a composite, carbon and/or wood.

Grip 16 is preferably associated with proximal end 24 of elongated shaft 12. Grip 16 is secured over a portion of shaft 12 via conventional means. Non-limiting examples of suitable putter grips include those commercially available from Golf Pride, Lamkin, Winn, Ping, and Super Stroke—just to name a few.

Image sensor 18 is preferably associated with, secured to, and/or forms part of putter head 14 and/or elongated shaft 12. In one embodiment (See FIGS. 1-7) image sensor 18 is secured to top surface 36 of putter head 14. In another embodiment (See FIGS. 10-13) image sensor 18 is secured to elongated shaft 12 proximate the hosel or distal end. In yet another embodiment (See FIGS. 14-15) one or more image sensor 18 are secured to and/or forms part of face 32 of putter head 14.

In one embodiment of the present invention, the putter assembly comprises one or more image sensors 18 for providing a user with an image (e.g., a photo, a video). Such images are real time and, among other things, enable the face angle of the putter to be properly aligned with the target (e.g., hole, pin, etcetera). Examples of suitable image sensors include video camera tubes, semiconductor charge-coupled devices (CCD), active pixel sensor in complementary metal-oxide-semiconductors (CMOS), N-type metal-oxide-semiconductors (NMOS, Live MOS), and back-side illuminated complementary metal-oxide-semiconductors (BSI-CMOS).

It will be understood that the above-identified image sensors are commercially available from a plurality of sources, including Agilent, Aptina, Canesta, Canon, Caeleste, CMOSIS, Dalsa, Eastman Kodak, ESS Technology, Fujifilm, MagnaChip, Matsushita, MAZeT GmbH, Mitsubishi, Nikon OmniVision Technologies, ON Semiconductor, Cypress Semiconductor, PixArt Imaging, Pixim, Samsung, Sharp, Sony, STMicroelectronics, Toshiba, TowerJazz, Town Line Technologies, TransChip, Trusight and Trusense Imaging—just to name a few suppliers.

Additional examples of suitable image sensors for use in accordance with the present invention include U.S. Pat. No. 6,359,323 B1 entitled "Color image sensor and method for fabricating the same," United States Patent Application Publication No. 2006/0043261 A1 entitled "Solid state image pickup device and image pickup system comprising it," U.S. Pat. No. 7,129,979 B1 entitled "Image sensor pixel for global electronic shuttering," United States Patent Application Publication No. 2004/0147059 A1 entitled "Method for manufacturing CMOS image sensor having microlens therein with high photosensitivity," U.S. Pat. No. 5,990,506 A entitled "Active pixel sensors with substantially planarized color filtering elements," U.S. Pat. No. 6,235,549 B1 entitled "Method and apparatus for employing a light shield to modulate pixel color responsivity," U.S. Pat. No. 6,765,276 B2 entitled "Bottom antireflection coating color filter process for fabricating solid state image sensors," U.S. Pat. No. 6,486,913 B1 entitled "Pixel array with shared reset circuitry," U.S. Pat. No. 6,872,584 B2 entitled "Solid state image sensor and method for fabricating the same," United States Patent Application Publication No. 2006/0011813 A1 entitled "Image sensor having a passivation layer exposing at least a main pixel array region and methods of fabricating the same," United States Patent Application Publication No. 2007/0187793 A1 entitled "Filter, color filter array, method of manufacturing the color filter array, and image sensor," U.S. Pat. No. 6,379,992 B2 entitled "Method for fabricating an image sensor," United States Patent Application Publication No. 2006/0138500 A1 entitled "CMOS image sensor and method for fabricating the same," United States Patent Application Publication No. 2005/0263839 A1 entitled "Photoelectric converting film stack type solid-state image pickup device, and method of producing the same," United States Patent Application Publication No. 2007/0090274 A1 entitled "Image sensors including active pixel sensor arrays," United States Patent Application Publication No. 2006/0157761 A1 entitled "Image sensor with self-boosting and methods of operating and fabricating the same," U.S. Pat. No. 6,369,417 B1 entitled "CMOS image sensor and method for fabricating the same," U.S. Pat. No. 6,127,668 A entitled "Solid state image pickup device and method for manufacturing the same," United States Patent Application Publication No. 2007/0023802 A1 entitled "CMOS image sensor and method of fabricating the same," United States Patent Application Publication No. 2005/0090035 A1 entitled "Method for fabricating CMOS image sensor protecting low temperature oxide delamination," and United States Patent Application Publication No. 2006/0261342 A1 entitled "Imaging device having a pixel cell with a transparent conductive interconnect line and the method of making the pixel cell"—all of which are hereby incorporated herein by reference in their entirety, including all references cited therein.

Display 20 is in communication with image sensor(s) 18 and provide the user with an output image of what the image sensor is reading/observing. This image may be unaltered or augmented with additional data for the user, such as distance to the hole, adjusted distance to the hole, STIMP conditions, layers for straight putts and/or layers for putts impacted by slope and/or break. Additional details pertaining to the functionality and information provided by display 20 are disclosed hereinbelow with reference to FIG. 9.

Preferably, display 20 is associated with the putter head, but it also may be associated with elongated shaft 12 and/or a portable electronic device (e.g., smart phones, Apple iPhones, Samsung Galaxy, tablets, Apple iPads, Microsoft Surface Pros, Apple Watches, digital watches, etcetera).

Non-limiting examples of displays include, for example, LCD displays, passive matrix displays, active matrix displays, LED displays, OLED displays, retina displays—just to name a few.

Putter assembly 10 preferably includes one or more energy sources 22 which are in electrical communication with image sensor 18 and/or display 20. Energy source 22 may comprise a primary and/or secondary electrochemical cell. In one embodiment, energy source 22 of putter assembly 10 preferably comprises, a secondary electrochemical cell, such as a lead acid, NiCad, NiMH, and/or lithium-ion battery and/or fuel cell. Preferred examples of lithium-ion batteries include lithium cobalt oxide ($LiC_0O_2$) batteries, lithium manganese oxide ($LiMn_2O_4$) batteries, lithium nickel manganese cobalt oxide ($LiNiMnC_0O_2$) batteries, lithium iron phosphate (LiFePO) batteries, lithium nickel cobalt aluminum oxide ($LiNiCoAlO_2$) batteries, and lithium titanate ($Li_4Ti_5O_{12}$) batteries. In one embodiment, energy source 22 comprises a secondary electrochemical cell having an anode, a cathode, and an electrolyte, wherein at least one of the anode, cathode, and electrolyte are monitored by a circuit board/controller, wherein variables pertaining to the structural integrity of the anode, the cathode, the electrolyte, a passivation layer associated with the anode and/or the cathode, and/or the cycle life of each component—including electrolyte level, are stored in a memory module. In this embodiment, the secondary electrochemical cell participates in reversible redox reactions. In addition, energy source 22 may be coupled with at least one of a fixed capacitor, a variable capacitor, and a polarized capacitor to regulate the storage of potential energy within putter assembly 10.

Referring once again to the Figures, and to FIGS. 1-7 in a first embodiment, FIGS. 10-13 in a second embodiment, and FIGS. 14-15 in a third embodiment, putter assembly 10 optionally includes one or more of mounting assembly 38 that includes primary body 40, securement member 42, adjustable sensor housing 44, and/or fasteners 46.

As is best shown in FIG. 8, putter assembly 10, in certain embodiments, includes electronics sub-assembly 50 having one or more of the following components, namely: switch 52, energy source and/or energy storage device 22, circuit board/controller (e.g., printed circuit board) 54, communication module 56 (e.g., wired, wireless, Bluetooth, Wi-Fi, RF, NFC), antenna 58, primary user interface via touch screen display 20, memory module 60, and accelerometer 62 (preferably 3 axis).

Referring now to FIG. 9, display 20 preferably displays distance to the target, adjusted distance to the target, and/or STIMP conditions. In one mode, the display provides a linear graphical overlay (A) that emanates perpendicular to the face of the putter head. In a second mode, the display provides a linear graphical overlay that emanates perpendicular to the face of the putter head and is adjusted for left/right break along the path to the intended target. In a third mode, the display provides a linear graphical overlay that emanates perpendicular to the face of the putter head and is adjusted for slope along the path to the intended target. In a fourth mode, the display provides a linear graphical overlay that emanates perpendicular to the face of the putter head and is adjusted for slope and left/right break along the path to the intended target (B) and (C). Overlay (B) is a downhill left-to-right breaking put, and overlay (C) is an uphill right-to-left breaking putt.

The foregoing description merely explains and illustrates the invention and the invention is not limited thereto except insofar as the appended claims are so limited, as those skilled in the art who have the disclosure before them will be able to make modifications without departing from the scope of the invention.

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etcetera shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can of course vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etcetera. As a non-limiting example, each range discussed herein can be readily broken down into a lower third, middle third and upper third, etcetera. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims.

What is claimed and desired to be secured by Letters Patent of the United States is:

1. A putter assembly, configured to facilitate improved alignment by enabling a face angle of the putter to be properly aligned with a pin/hole, comprising:—an elongated shaft;—a putter head;—a grip;—a mounting assembly secured to the elongated shaft, wherein the mounting assembly includes a primary body, a securement member, an adjustable sensor housing and one or more fasteners, and wherein a bottom surface of the primary body contacts a top surface of the putter head and further wherein a top surface of the primary body contacts a bottom surface of the adjustable sensor housing;—an image sensor, wherein the image sensor is associated with at least one of the putter head and the elongated shaft;—a display, wherein the display is in communication with the image sensor, and the display contacts and forms part of the putter head; and—an energy source, wherein the energy source is positioned within the primary body of the mounting assembly and is in electrical communication with the image sensor and the display.

* * * * *